United States Patent [19]

Ireland

[11] Patent Number: 4,610,149

[45] Date of Patent: Sep. 9, 1986

[54] EARRING SUPPORT

[75] Inventor: Thomas R. Ireland, Cumberland, R.I.

[73] Assignee: Hallmark Findings, Inc., Warwick, R.I.

[21] Appl. No.: 637,713

[22] Filed: Aug. 3, 1984

[51] Int. Cl.[4] ..... A44C 7/00

[52] U.S. Cl. ..... 63/12; 428/397

[58] Field of Search ..... 63/2, 12, 13; 428/397

[56] References Cited

U.S. PATENT DOCUMENTS

| | | | |
|---|---|---|---|
| D. 264,060 | 4/1982 | Epstein | 63/13 X |
| 3,853,416 | 12/1974 | Hanan | 63/12 X |
| 4,106,310 | 8/1978 | Abramowitz | 63/12 X |

*Primary Examiner*—F. Barry Shay

*Attorney, Agent, or Firm*—Lewis H. Eslinger

[57] ABSTRACT

A metal support for a pierced earring comprises an elongated solid member with uniform non-circular cross-section. The cross-section has maximum dimensions in at least two angularly displaced directions to provide substantial resistance to deformation in these two directions, while having relatively small dimensions in directions between these two directions to minimize the weight of the solid member as compared with the weight for a cylindrical member of a diameter equal to the maximum dimensions.

3 Claims, 6 Drawing Figures

EARRING SUPPORT

BACKGROUND OF THE INVENTION

1. Field of the Invention

The present invention relates generally to pierced earrings and, more particularly, pertains to a configuration for an earring support and a pierced earring incorporating the novel support.

2. Discussion of the Prior Art

Pierced earrings have been in wide use throughout the world since antiquity. Typically, a pierced earring is comprised of a support which passes through the pierced opening of the wearer's earlobe, and an ornamental portion which is attached to or suspended from the support. The support may be either a straight post, in which form it is generally of a length sufficient to extend through the earlobe, and to receive a clasp at the back of the latter; or the support may be an ear wire, which may have a substantial length and sinuous or inverted hook shape, thus forming part of the ornamentation of the earring as a whole.

As is also well known, earring posts or ear wires of the type previously described are normally constructed of precious metal, such as silver or gold, so as to be hypoallergenic and thereby to minimize the danger of infection or contamination to the wearer. Not only are such precious metals hypoallergenic in and of themselves, but they are readily cleaned and disinfected without damage. Because of the desirability of having earrings with supports made from precious metals, and in view of the escalating costs of these materials, it is highly desirable to minimize the amount of precious metal used in constructing the support of the earring. In the case of an ear wire which is observable when worn, it is highly desirable that, while reducing the amount of precious metal used, an attractive shape should be maintained. However, it is essential that the earring support of either kind be strong enough to resist breaking, and thereby avoid the loss of the earring itself.

Generally, in the past, earring posts have been made with a solid cylindrical configuration of small diameter. Recently, it has been proposed to manufacture hollow earring posts for reducing the amount of precious metal thereon. One form of such hollow earring posts has been described in U.S. Pat. No. 4,307,582, to Mancini. A different type of hollow earring post has been proposed in U.S. patent application Ser. No. 476,051, filed Mar. 17, 1983, and having a common assignee herewith. However, such hollow earring posts are relatively difficult to produce, and are susceptible to crushing or flattening when the wall thickness is reduced. Therefore, due to the high cost of the precious metals used in constructing earring posts or ear wires, it is desirable to provide other constructions for reducing the amount of metal used, while still providing relative ease of manufacture, as by extrusion or drawing, and high resistence to crushing or flattening.

OBJECTS AND SUMMARY OF THE INVENTION

It is an object of the present invention to provide a support for pierced earrings which provides a reduction in the amount of material used in its construction as compared with conventional posts, while retaining substantial resistance to bending or deformation and breaking.

Another object of the present invention is to provide an improved metal support for a pierced earring, as aforesaid which may be easily and inexpensively manufactured.

A further object of the present invention is to provide an ear wire having an attractive shape which yet effectively decreases the amount of material required to form it, thereby decreasing the overall cost of the earring.

In accordance with an aspect of the present invention, a metal support for a pierced earring is provided in the form of an elongated solid member having a uniform noncircular cross-section, the uniform cross-section having maximum dimensions in at least two angularly displaced directions to provide substantial resistance to deformation in the two directions, the cross-section having also relatively small dimensions in directions between the two or more directions of maximum cross-sectional dimensions for minimizing the weight of the solid member as compared with the weight of a cylinder of circular cross-section having a diameter equal to said maximum dimensions.

The foregoing, and other objects, advantages and characterizing features of the invention, will become more readily apparent from the following detailed description of preferred embodiments thereof, taken in conjunction with the accompanying drawing wherein like reference numerals denote similar parts throughout the various views:

DESCRIPTION OF THE PREFERRED EMBODIMENTS

Figure 1:
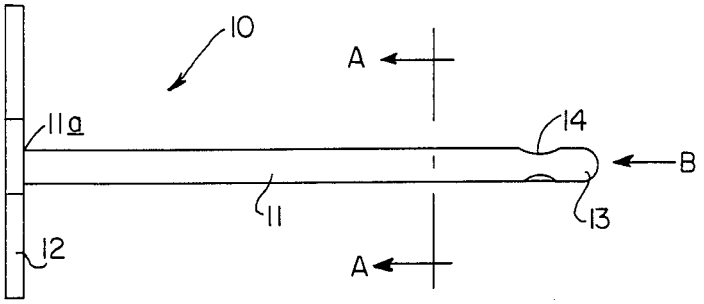
FIG. 1 is a side elevational view of a pierced earring with a post according to an embodiment of the present invention.

Referring in detail to the drawings, and initially to FIG. 1 thereof, a pierced earring 10 according to the present invention is shown to have a support in the form of a post 11 attached at one end 11*a*, to an ornamental member 12. Ornamental member 12 may be affixed to post 11 by any conventional means, such as by soldering. As shown in FIG. 1, post 11 is straight and is understood to be of sufficient length to extend through the pierced opening of a wearer's earlobe. At the other or free end 13 of post 11 remote from ornamental member 12 is a circumferential groove-like depression 14 adapted to accept a conventional clamp or clasping member which grasps the post 11 in back of the earlobe to prevent removal of the earring therefrom. Any other conventional means for preventing removal of the earring from the earlobe of course may be substituted for circumferential groove-like depression 14 and the clasp intended to engage the same.

Generally, in accordance with the present invention, the post 11 is solid and formed with a uniform non-circular cross-section, for example, having at least three straight sides joined at angles, so as to have maximum dimensions $D_1$ (FIG. 2) in a plurality of angularly displaced directions, for example, in directions extending from a center of the cross-section to the angles or corners thereof, and further having relatively small dimensions $D_2$ in directions between the directions of the maximum dimensions, for example, in directions extending from the center of the cross-section to the middles of the straight sides.

Figure 2:
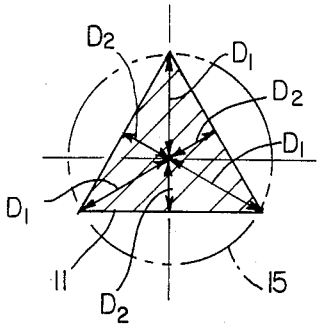
FIG. 2 is an enlarged cross-sectional view of the post of FIG. 1, taken along the line A—A.

In the preferred embodiment of the present invention shown on FIG. 2, post 11 has a uniform cross-section in the shape of an equilateral triangle. A simple geometrical calculation shows that the area of the equilateral triangular cross-section is only about 41% of the area of a circle 15 in which it may be inscribed. Consequently, the amount of material needed to construct the novel support of the present invention, in this preferred embodiment, is only about 41% of that required to form a conventional earring support of circular cross-section and equal maximum dimensions. Even if the maximum dimensions of the novel ear support of the present invention in the triangular embodiment are increased to be slightly larger than the corresponding diameter of a cylindrical ear support, the savings in precious metal or other material saved are significant. Furthermore, the novel earring support of triangular cross section retains substantial strength against bending or other deformation as compared with the cylindrical conventional earring supports. Thus the novel earring support of the present invention combines the necessary strength with the desired reduction in amount of material used to present a highly advantageous improvement.

In addition, since the earring post or earwire to having a triangular cross-section according to this invention is solid, it may be easily and inexpensively manufactured by an extrusion or drawing process.

Figure 3:
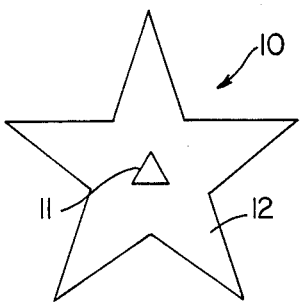
FIG. 3 is an end elevational view of the pierced earring of FIG. 1 as viewed in the direction of the arrow B.

FIG. 3 shows a view of the novel ear support according to the preferred embodiment viewed in the direction of arrow B in FIG. 1. Here it may be seen that, by way of example, the ornamental member 12 may have the shape of a star and is centrally supported by the triangular earring post 11.

Figure 4:
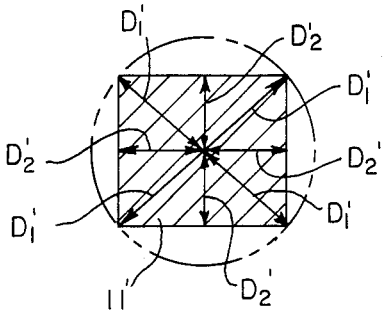
FIG. 4 is another cross-sectional view similar to that of FIG. 2, but showing another embodiment of the present invention.

FIG. 4 shows another embodiment of an earring post 11' according to the present invention, and wherein the post 11' has a square cross-section. A calculation similar to that performed with respect to the triangular embodiment shows that the ratio of the area of the square to the area of the circumscribed circle 15 is about 63%. Again, this embodiment provides a significant reduction in the amount of precious material that need be used, while still providing the necessary strength against bending or breaking required in the construction of an ear support due to the provision of the maximum dimensions $D_1'$ in the four angularly spaced directions corresponding to the corners of the square cross-section and the relatively small dimension $D_2'$ in the directions therebetween.

Figure 5:
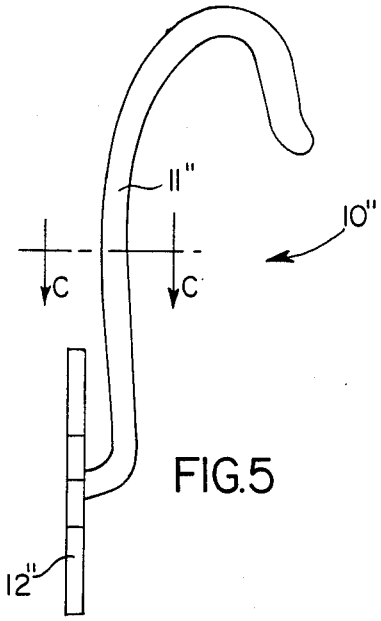
FIG. 5 is a side elevational view of an earring with an ear wire according to an embodiment of the present invention.
Figure 6:
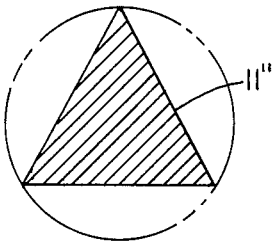
FIG. 6 is an enlarged cross-sectional view of the ear wire of FIG. 5 then along the line C—C.

FIGS. 5 and 6 show an embodiment of the present invention in the form of a pierced earring 10'' having a curved ear wire 11''. In this type of ear support, the ear wire 11'' itself forms part of the ornamentation of the pierced earring, and thus should be of an attractive shape, in addition to providing the other advantages of resistance to bending and reduction in material used. The triangular or square cross-sectional embodiments discussed above provide such advantageous features.

Therefore, the novel ear support of the present invention, and the pierced earring incorporating the ear support of the present invention, present the highly advantageous features of reduced cost due to reduced amount of material used in manufacture, strength against bending or deformation sufficient to support the ornamental member when worn, and attractive shape. Additionally, the ear support of the present invention is easily and inexpensively manufacturable. In view of the already high and rapidly increasing prices for the precious metals, particularly gold, used in manufacturing supports for pierced earrings, these advantages are highly significant and desirable.

Although preferred embodiments of the invention have been described and illustrated in detail herein, it should be realized that the invention is not limited to these particular embodiments, and that modifications and variations may be effected therein by one skilled in the art without departing from the spirit and scope of this invention as defined in the appended claims.

What is claimed is:

1. A metal support for a pierced earring, comprising an elongaged solid earring post formed of precious metal and having a uniform non-circular cross-section, said uniform cross-section being an equilateral triangle having maximum dimensions in at least two angularly displaced directions to provide substantial resistance to deformation in said two directions, said cross-section having relatively small dimensions in directions between said two directions and being formed having three straight sides joined at acute angles, said maximum dimensions extending from a center of the cross-section to said angles and said small dimensions extending from said center to the middle of said straight sides, whereby the weight of said earring post compared with the weight for a cylinder of a circular cross-section having a diameter equal to said maximum dimensions is minimized.

2. A pierced earring, comprising;

an elongaged solid metal earring post formed of precious metal for passing through an ear lobe having a uniform non-circular cross-section and an end portion, said uniform cross-section being an equilateral triangle having maximum dimensions in at least two angularly displaced directions to provide substantial resistance to deformation in said two directions, said cross-section having relatively small dimensions in directions between said two directions and said non-circular cross-section portion having three straight sides joined at angles, said maximum dimensions extending from a center of the cross-section to said angles and said small dimensions extending from said center to the middles of said straight sides, whereby the weight of said solid member as compared with the weight for a cylinder of circular cross-section having a diameter equal to said maximum dimensions is minimized; and an ornamental member affixed to said end portion.

3. A pierced earring according to claim 2, wherein said ornamental member is comprised of precious metal.

* * * * *